United States Patent [19]

Allison

[11] Patent Number: 4,677,961

[45] Date of Patent: Jul. 7, 1987

[54] CLAY PIGEON LAUNCHER

[76] Inventor: James A. Allison, 3701 N. Mio Rd., Rose City, Mich. 48654

[21] Appl. No.: 797,037

[22] Filed: Nov. 12, 1985

[51] Int. Cl.[4] ..... F41J 9/18

[52] U.S. Cl. ..... 424/5

[58] Field of Search ..... 124/5, 6, 7, 8; 273/318, 322

[56] References Cited

U.S. PATENT DOCUMENTS

| | | | |
|---|---|---|---|
| 1,306,381 | 6/1919 | Johnson | 124/5 |
| 1,306,393 | 6/1919 | Sibley | 124/5 |
| 3,428,036 | 2/1969 | Parker | 124/5 |
| 4,157,828 | 6/1979 | Cosmopulos | 124/5 X |

FOREIGN PATENT DOCUMENTS

| | | | |
|---|---|---|---|
| 753192 | 8/1933 | France | 124/5 |
| 2321107 | 3/1977 | France | 124/5 |
| 2112290 | 7/1983 | United Kingdom | 124/5 |

*Primary Examiner*—Paul E. Shapiro

*Attorney, Agent, or Firm*—Learman & McCulloch

[57] ABSTRACT

A clay pigeon launcher has a handle at one end of which is pivoted a trough-like carrier having a base flanked by a pair of spaced, parallel walls that straddle the handle. The walls of the carrier extend beyond one end of the base for pivotal connection to the handle so as to enable the carrier to be rocked between operative and stored positions. In the operative position the base of the carrier abuts the handle and limits relative rocking movement in one direction of the base and handle. In the operative position of the trough the base and handle form an included angle therebetween of about 115°.

6 Claims, 4 Drawing Figures

CLAY PIGEON LAUNCHER

BACKGROUND OF THE INVENTION

Numerous kinds of devices have been proposed heretofore for use in launching projectiles such as clay pigeons. Some of the known devices are so constructed as to be usable only by a right-handed person or by a left-handed person, but not both. Others rely upon swinging links and springs to impart rotation to a launched projectile. Some of the spring-operated launchers generate recoil forces upon launching of the projectile, and such recoil forces can result in excessive operator fatigue and pain.

Although known launchers have some desirable characteristics, they also have many undesirable characteristics, some of which have been mentioned above. One of the major drawbacks of known launchers is that the speed of a projectile and the length and direction of its airborne path may not always be controlled to the extent desired.

An object of the present invention is to provide a launcher for a projectile such as a clay pigeon and which overcomes the disadvantages of devices in use heretofore for a similar purpose.

SUMMARY OF THE INVENTION

A clay pigeon launcher constructed in accordance with the invention has an elongate handle at one end of which is a trough-like carrier having a pair of parallel sides walls spaced by a base. The carrier is open at both ends and, at one end, the walls project beyond the base and straddle the handle. The projecting walls are pivoted to the handle so as to enable the carrier to be swung from a projected, operative position to a retracted, storage position. In the operative position the base of the carrier abuts the handle and limits pivotal movement of the carrier beyond the operative position. In the operative position the base of the carrier and the handle form an included angle of about 15°. The handle is of such length that considerable velocity of the carrier may be achieved in response to arcuate swinging movement of the handle. The length of the carrier is such that one or more clay pigeons may be supported therein and, as each pigeon leaves the carrier, a rotary motion is imparted thereto for flight stability.

DESCRIPTION OF THE DRAWINGS

A launcher constructed in accordance with the presently preferred embodiment of the invention is illustrated in the accompanying drawings wherein.

DETAILED DESCRIPTION

Figure 1:
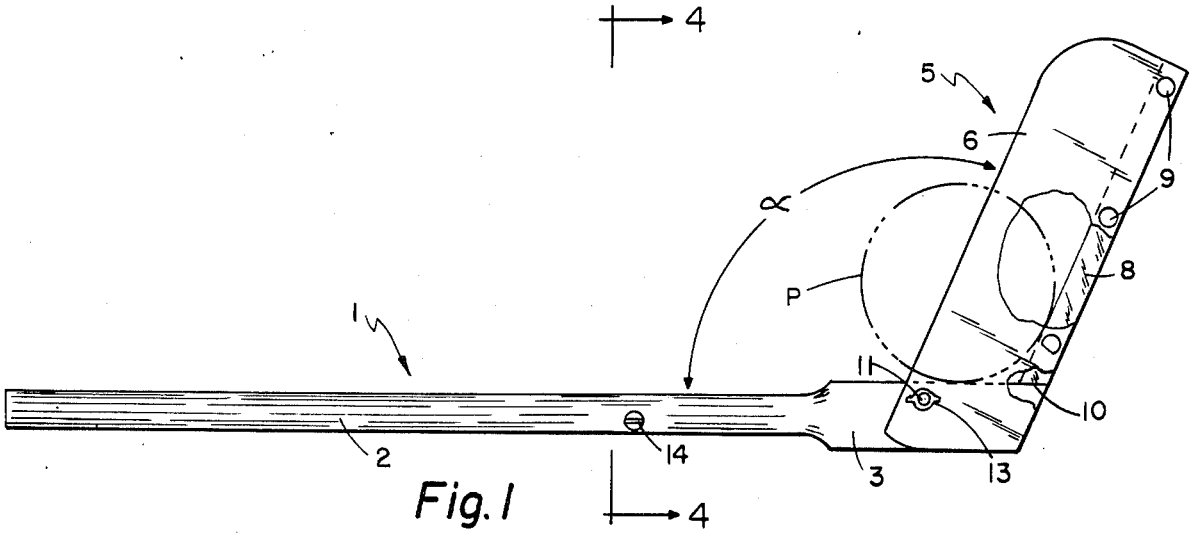
FIG. 1 is a plan view, with parts broken away, of a launcher in condition to launch a projectile such as a clay pigeon.

A launcher for a clay pigeon or similar projectile comprises an elongate handle 1 having a first portion 2 terminating at one end in an enlarged portion 3. The widths of the handle portions 2 and 3 are the same, but the height of the portion 3 is greater than that of the portion 2. The free end 4 of the enlarged portion 3 of the handle preferably is chamfered.

The launcher also includes a carrier 5 comprising a pair of parallel walls 6 and 7 of preferably uniform size and spaced from one another by a base 8 that is secured to the walls by rivets 9 or the like. The spacing between the walls is sufficient to accommodate a projectile such as a clay pigeon.

One end of the base 8 is flush with the corresponding ends of the walls 6 and 7, but the opposite end 10 of the carrier base terminates short of the corresponding ends of the walls 6 and 7 which project beyond the base so as to straddle the enlargement 3 of the handle. The projecting ends of the carrier walls 6 and 7 are pivoted to the handle 1 by means of a pivot pin or bolt 11 having a head 12 at one end and a wing nut 13 at the other end. The carrier 5 thus is rockable about the axis of the pin 11 from an extended, operative position shown in FIG. 1 to a retracted, storage position shown in FIG. 2.

Figure 2:
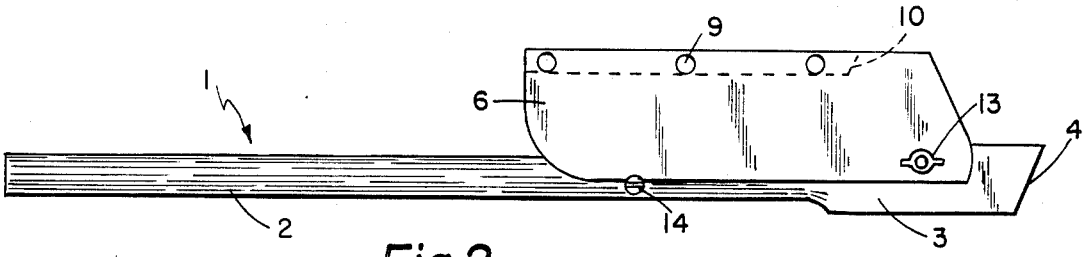
FIG. 2 is a view similar to FIG. 1, but illustrating the launcher in an adjusted position.
Figure 3:
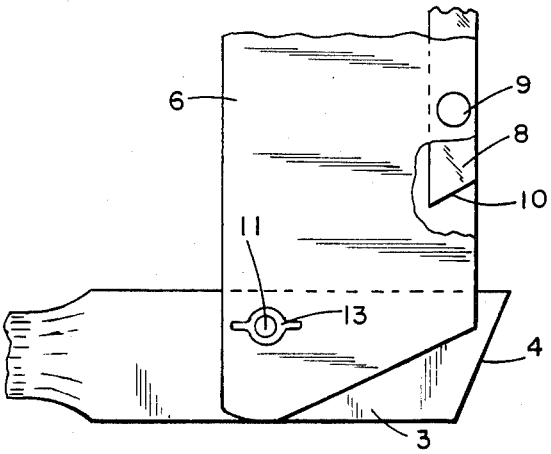
FIG. 3 is a fragmentary view, on an enlarged scale, illustrating the parts of the launcher in still other adjusted positions.
Figure 4:
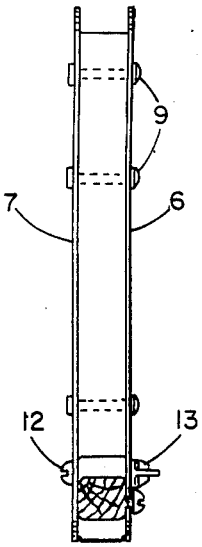
FIG. 4 is a sectional view taken on the line 4—4 of FIG. 1.

Preferably, the handle portion 2 has a stop 14 projecting from one side of the handle and lying in the path of movement of the wall 6 so as to limit counterclockwise rotation of the carrier 5 beyond the position shown in FIG. 2 and in which position the base 8 is substantially parallel to the handle 1.

The length of the carrier base 8 is such that, when the latter is in its projected, operative position, its free end 10 abuts the handle portion 3 and prevents further clockwise movement of the carrier beyond the position shown in FIG. 1. In this position the base 8 and the handle 1 form an included angle $\alpha$ the vertex of which is at the juncture of the handle and the carrier base. The included angle may be between about 110° and 120°, and preferably about 115°. It has been found that this angular relationship between the handle 1 and the carrier base 8 enables the best directional control to be obtained when a projectile P accommodated in the carrier 5 is launched.

Although the dimensions of a launcher constructed in accordance with the invention may be varied somewhat, it has been found that the utilization of a handle of twenty-eight and one-half inches in length and a carrier having a base of eight and five-eighths inches in length enables most teenage and adult persons to launch a clay pigeon at speeds of between forty-five and sixty miles per hour, or more, and enables the clay pigeon to traverse a distance of up to one hundred yards. Since launching of the projectile is not dependent upon spring action no recoil is encountered upon discharge of the projectile from the carrier. Thus, a person utilizing the launcher is not subjected to recoil forces which may cause fatigue or pain.

The provision of two walls 6 and 7 for the carrier 5 enables the launcher to be used with equal facility by left-handed and right-handed persons.

One of the advantageous characteristics of the launcher is that the flight of a launched projectile may be well-controlled within certain limits. Thus, if the opposite ends of the carrier are at the same level in a horizontal plane when a clay pigeon is launched, it will have a trajectory that is straight, rather than curving left or right. If the free end of the carrier is tipped downwardly by a right-handed person, the clay pigeon will have a trajectory curving toward the right, whereas if such person tips the free end of the carrier upwardly, the pigeon's trajectory will curve toward the left.

The length of the carrier base 8 preferably is such as to enable two clay pigeons to be supported and launched simultaneously. As the launcher is swung, each clay pigeon will be urged against the base 8 by centrifugal force, as a result of which the pigeon will roll along the base toward the open end of the carrier. Thus, each pigeon will have rotary motion imparted thereto for greater flight stability.

The disclosed embodiment is representative of a presently preferred form of the invention, but is intended to be illustrative rather than definitive thereof. The invention is defined in the claims.

I claim:

1. A launcher for a projectile such as a clay pigeon comprising a carrier having a base flanked by a pair of spaced, parallel walls forming a trough open along one side at both ends, said walls projecting beyond said base at one end of said body; an elongate handle straddled by the projecting walls of said carrier; and means connecting said projecting walls to said handle with said base abutting said handle, said base and said handle having therebetween an included angle of between about 110° and 120°.

2. A launcher according to claim 1 wherein said included angle is about 115°.

3. A launcher according to claim 1 wherein said connecting means comprises a pivot.

4. A launcher according to claim 3 wherein said base abuts said handle and limits relative pivotal movement in one direction of said carrier and said handle.

5. A launcher for a projectile such as a clay pigeon comprising a carrier having a base joined to at least one upstanding side wall; an elongate handle; and means pivotally mounting said carrier on said handle adjacent one end thereof enabling rocking movements of said carrier relative to said handle, said one end of said handle abutting one end of said base and forming an upstanding end wall for said carrier and limiting relative rocking movement of said base and said handle in one direction, said base and said end wall forming therebetween an obtuse included angle.

6. A launcher according to claim 5 wherein said carrier includes a second side wall parallel to said one side wall and spaced therefrom by said base a distance enabling said side walls to straddle said one end of said handle.

* * * * *